US007711092B2

(12) United States Patent
Baumann

(10) Patent No.: US 7,711,092 B2
(45) Date of Patent: May 4, 2010

(54) X-RAY LENS ASSEMBLY AND X-RAY DEVICE INCORPORATING SAID ASSEMBLY

(75) Inventor: Thomas Baumann, Munster (DE)

(73) Assignee: Unisantis Fze, Dubai (AE)

( * ) Notice: Subject to any disclaimer, the term of this patent is extended or adjusted under 35 U.S.C. 154(b) by 10 days.

(21) Appl. No.: 12/064,388

(22) PCT Filed: Aug. 17, 2006

(86) PCT No.: PCT/EP2006/008141

§ 371 (c)(1),
(2), (4) Date: Jul. 28, 2008

(87) PCT Pub. No.: WO2007/022916

PCT Pub. Date: Mar. 1, 2007

(65) Prior Publication Data

US 2008/0317211 A1 Dec. 25, 2008

(30) Foreign Application Priority Data

Aug. 22, 2005 (EP) ..... 05018171

(51) Int. Cl.
*G21K 1/00* (2006.01)

(52) U.S. Cl. ..... 378/145; 378/84

(58) Field of Classification Search ..... 378/84, 378/85, 145
See application file for complete search history.

(56) References Cited

U.S. PATENT DOCUMENTS 5,101,422 A * 3/1992 Thiel et al. ..... 378/145
5,192,869 A 3/1993 Kumakhov
6,504,901 B1 1/2003 Loxley et al.

FOREIGN PATENT DOCUMENTS

DE 100 56 508 A1 4/2002
JP 4-307400 A 10/1992

OTHER PUBLICATIONS

International Search Report of PCT/EP2006/008141, date of Mailing Oct. 6, 2006.

* cited by examiner

*Primary Examiner*—Chih-Cheng G Kao
(74) *Attorney, Agent, or Firm*—Westerman, Hattori, Daniels & Adrian, LLP

(57) ABSTRACT

An X-ray lens assembly, a device including the X-ray lens assembly and a method of manufacturing the X-ray lens assembly are described. The X-ray assembly comprises a tube member (50) including an inlet opening (90) for X-rays and an outlet opening (94) for X-rays. Additionally, the assembly comprises a capillary X-ray lens (28) mounted inside the tube member (50). The X-ray lens (28) may be mounted inside the tube member (50) by a stabilizing agent and/or by one or more separate mounting structures (96A, 96B).

9 Claims, 5 Drawing Sheets

X-RAY LENS ASSEMBLY AND X-RAY DEVICE INCORPORATING SAID ASSEMBLY

FIELD OF THE INVENTION

The present invention relates to an X-ray lens assembly and a method of manufacturing the assembly. The invention further relates to an X-ray device such as an X-ray spectrometer or an X-ray diffractometer comprising an X-ray lens assembly.

BACKGROUND OF THE INVENTION

The advent of so-called X-ray lenses (also called "Kumakhov lenses") over two decades ago has prepared the ground for lightweight, portable X-ray devices with a broad spectrum of applications in areas as different as metallurgy, geology, chemistry, forensic laboratories and customs inspection. In a similar way as conventional optical lenses redirect visible or near-visible photons, X-ray lenses redirect electromagnetic radiation in the X-ray radiation band and may thus be used to collimate or focus a beam of X-rays.

An X-ray lens is conventionally formed from a plurality of capillaries. Each capillary guides the X-rays captured at a front end thereof to the opposite end by way of total external reflection. This rule applies so long as the angle of incidence at the front end does not exceed a critical angle. If the critical angle is exceeded, X-rays can no longer be captured within the capillary. In such a case, the capillary becomes transparent to the X-rays.

Originally, an X-ray lens was a bulky device with dimensions in the region of up to several meters. These large dimensions were mainly the result of separate support structures that were required to keep the individual capillaries in place. Commercial use of X-ray lenses became feasible when it was recognized that the support structures can be omitted if the X-ray lens is produced out of one or more glass capillary bundles using glass drawing techniques. By fusing the capillary mantles together, separate support structures became obsolete.

Today, the commercial application of X-ray lenses includes portable X-ray spectrometers, lightweight X-ray diffractometers and many other small-sized devices. Such devices typically comprise an X-ray source (such as an X-ray tube), an X-ray lens and a detector. X-rays emitted from the X-ray source are focused by the X-ray lens onto a tiny spot on a sample. The detector detects the X-rays emitted back from the sample and generates an output signal that can for example be spectrally analysed to determine the chemical elements included in the sample.

In X-ray devices the X-ray lenses have to be reliably mounted to ensure a proper operation of the X-ray devices. Often, the X-ray lenses have to be mounted such that the distance of the lens to either one or both of the X-ray source and the sample is adjustable. Due to the fragileness of capillary X-ray lenses the transport, mounting and adjustment of X-ray lenses often poses a challenge. The mounting of X-ray lenses is further complicated by the fact that X-ray lenses may have varying individual dimensions.

Accordingly, there is a need for an X-ray lens assembly that facilitates at least one of transport, mounting and adjustment of a capillary X-ray lens. Also, there is a need for an X-ray device including such an X-ray lens assembly and a method for manufacturing the X-ray lens assembly.

SUMMARY OF THE INVENTION

According to a first aspect of the invention, an X-ray lens assembly comprising a tube member including an inlet opening for X-rays and an outlet opening for X-rays as well as a capillary X-ray lens mounted inside the tube member is provided.

The tube member may have internal and external cross-sections of arbitrary shapes. The cross-sections may for example have a circular, oval or polygonal shape. The X-ray lens may comprise one or more capillaries. The capillaries may be grouped into one or several capillary bundles.

In one variation, the X-ray lens is mounted inside the tube member by a stabilizing agent. Preferably, the stabilizing agent (e.g. a glue) possesses at least one of hardening and interconnecting properties.

In a region between the inlet opening and the outlet opening of the tube member at least one chamber may be defined between the X-ray lens and the tube member. The at least one chamber may serve for various purposes. In one embodiment, the at least one chamber is filled with the stabilizing agent.

Between the inlet opening and the outlet opening of the tube member one or more further openings may be provided. Preferably, the one or more further openings are communicating with the at least one chamber. The further openings may be used to fill the stabilizing agent into the chamber. Additionally or in the alternative, the one or more openings may serve as air outlets (e.g. during the insertion of the X-ray lens into the tube member and/or during the filling of the chamber with the stabilizing agent).

In addition to the stabilizing agent, or in the alternative, one or more mounting structures may be provided for mounting the X-ray lens inside the tube member. Two axially spaced mounting structures may be provided for limiting the at least one chamber in an axial direction of the tube member.

One or more of the mounting structures may have a substantially circular opening in which the X-ray lens is received. The one or more mounting structures may comprises at least one elastic member such as an elastic ring (e.g. an O-ring).

The at least one mounting structure may allow for an axial displacement of the X-ray lens within the tube member. An axial adjustment may become necessary when adjusting the position of the X-ray lens in relation to the tube member. Moreover, an axial adjustment may be required in context with positioning the X-ray lens in relation to at least one of an X-ray source and a sample to be irradiated with X-rays.

The tube member is preferably made from a material substantially intransparent to X-rays such as steel. In one embodiment, the axial length of the tube member is equal to or larger than the axial length of the X-ray lens.

According to a further aspect of the invention, an X-ray device is provided. The X-ray device comprises an X-ray source and an X-ray lens assembly including a tube member having an inlet opening for X-rays and an outlet opening for X-rays as well as a capillary X-ray lens mounted inside the tube member.

According to a still further aspect of the invention, a method of manufacturing an X-ray lens assembly is provided. The method comprises the steps of providing a tube member having an inlet opening for X-rays and an outlet opening for X-rays, providing a capillary X-ray lens, and mounting the X-ray lens inside the tube member.

The step of mounting the X-ray lens inside the tube member may include the sub-step of arranging the at least two lens mounting structures at an axial distance between the tube member and the X-ray lens. Additionally or in the alternative, the mounting step may include the sub-steps of defining at least one chamber between the tube member and the X-ray lens, and filling a stabilizing agent into the at least one chamber.

BRIEF DESCRIPTION OF THE DRAWINGS

Further aspects, advantages and variations of the invention will become apparent from the following description of a preferred embodiment and from the drawings.

DESCRIPTION OF A PREFERRED EMBODIMENT

In the following, the invention will exemplarily be described with reference to a preferred embodiment in the form of an X-ray spectrometer comprising an X-ray lens assembly comprising two axially spaced mounting structures that define a chamber filled with a stabilizing agent. It should be noted that the invention can also be practiced in other X-ray devices such as diffractometers and using different mechanisms for mounting the X-ray lens inside the tube member. For example, the stabilizing agent may be omitted if the mounting structures allow for a sufficiently reliable connection between the X-ray lens and the tube member. Alternatively, the mounting structures may be completely omitted (or subsequently removed) if the stabilizing agent allows for a secure and durable mounting of the X-ray lens in the tube member. Also, the number and types of mounting structures may be varied.

Figure 1:
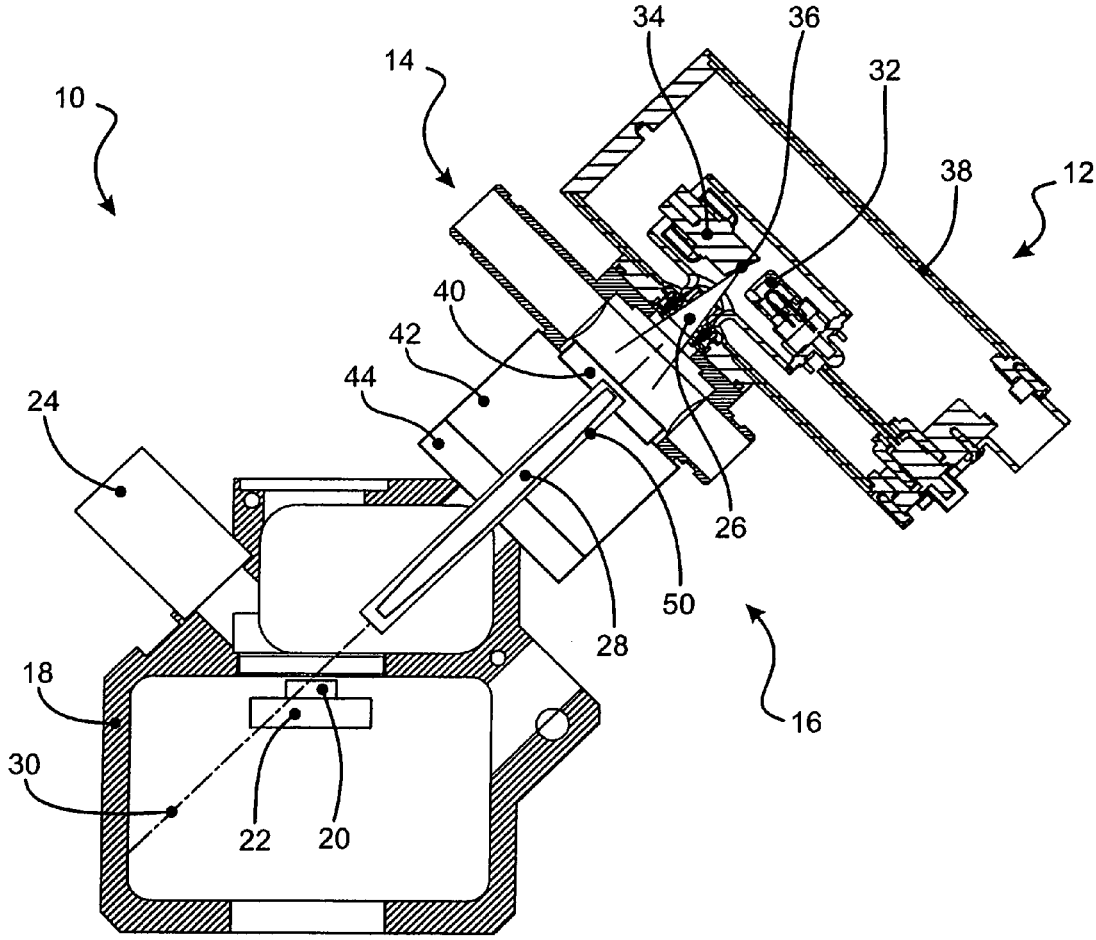
FIG. 1 shows a cross sectional view of an X-ray spectrometer embodiment of the present invention.

FIG. 1 shows a cross sectional view of an X-ray spectrometer 10 according to an embodiment of the present invention. The spectrometer 10 includes an X-ray source 12 constituted by an X-ray tube. The spectrometer 10 further comprises a shutter 14, a positioning/shielding module 16, a sample housing 18 with a sample 20 arranged on a sample positioning platform 22, and a detector 24.

An X-ray beam generated within the X-ray source 12 and indicated by reference numeral 26 passes along an optical axis 30 through the shutter 14. A capillary X-ray (or Kumakhov) lens 28 mounted inside a tube member 50 focuses the X-ray beam onto a tiny spot on the sample 20 (note that the size of the sample 20 is exaggerated in the schematic drawing of FIG. 1). The detector 24 collects the X-rays emitted back from the sample 20 and outputs a spectrum signal indicative of the chemical elements included in the sample 20. In the view of FIG. 1, the X-ray source 12 and the shutter 14 have been rotated by 90° about the optical axis 30 of the spectrometer 10 to better illustrate their structure.

The spectrometer 10 shown in FIG. 1 has a compact tabletop design and is transportable for in-situ analysis. The samples may be provided in a wide range of physical forms, including solids, powders, pressed pellets, liquids, granules, films and coatings. The typical element detection capabilities of the spectrometer 10 under atmospheric conditions range from aluminum (Al) to uranium (U). The spectrometer 10 allows for a qualitative and quantitative elemental analysis down to very low elemental concentrations and sample sizes of 20 μm.

Like conventional X-ray tubes, the X-ray source 12 includes a cathode 32 to emit electrons and an anode 34 to collect the electrons emitted by the cathode 32. Thus, a flow of electrical current is established as the result of a high voltage connected across the cathode 32 and the anode 34. The electron flow within the X-ray source 12 is focussed onto a very small spot (the "hot spot") 36 on the anode 34. The anode 34 is precisely angled at typically 5 to 15 degrees off perpendicular to the electron current so as to allow the escape of some of the X-rays generated at the "hot spot" 36 upon annihilation of the kinetic energy of the electrons colliding with the anode 34. The X-ray beam 26 thus generated is emitted from the "hot spot" 36 essentially perpendicular to the direction of the electron current and essentially along the optical axis 30 at diverging angles.

The X-rays emitted from the X-ray source 12 first pass the shutter 14 attached to a housing 38 of the X-ray source 12. The shutter 14 selectively blocks the X-ray beam 26 generated within the X-ray source 12 and thus provides a control mechanism for selectively switching the irradiation of the sample 20 "on" or "off".

Figure 2:
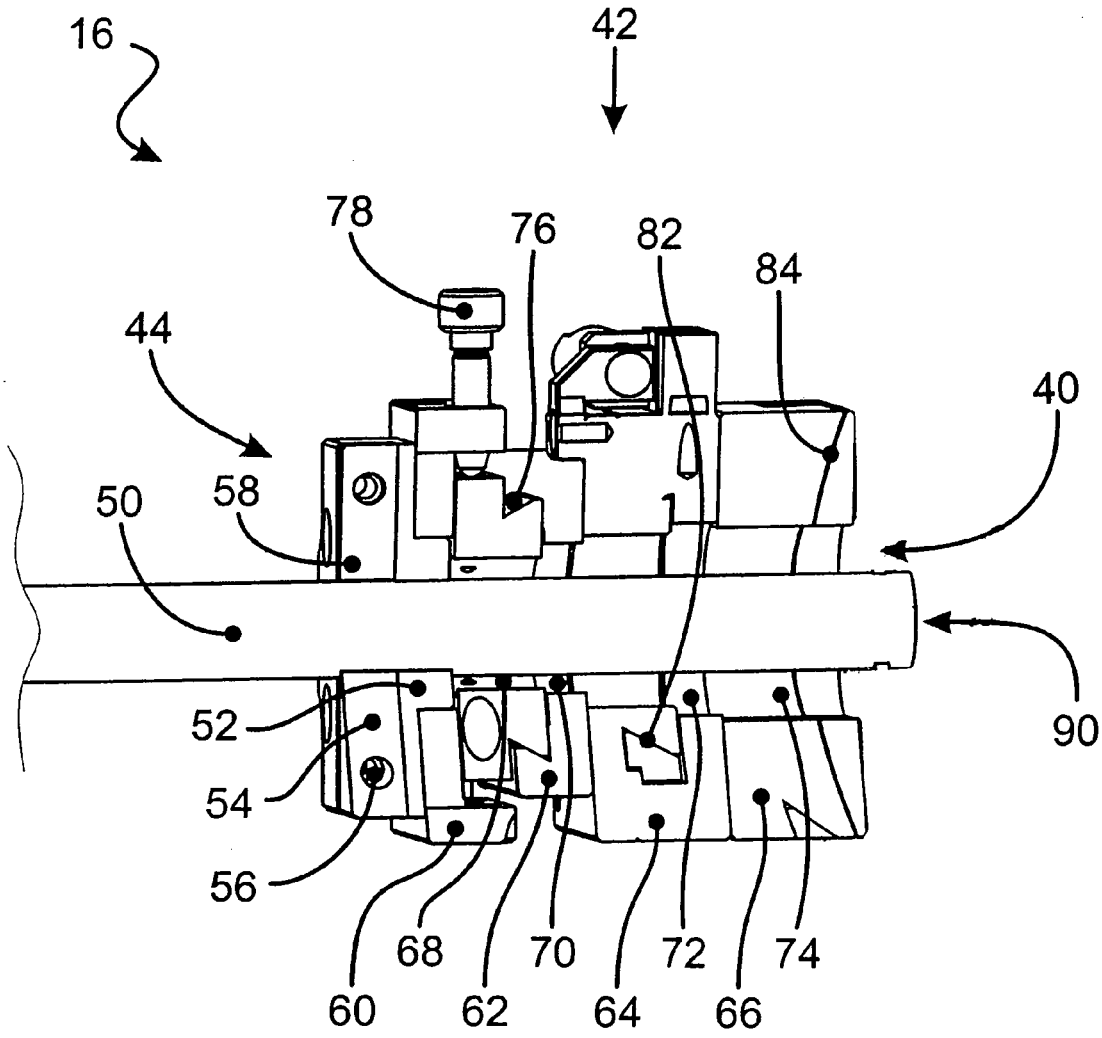
FIG. 2 shows a cross sectional view of a mounting and positioning apparatus for a lens assembly included in the X-ray spectrometer of FIG. 1.

The positioning/shielding module 16 is arranged downstream (in relation to X-ray source 12) of the shutter 14 and is rigidly attached to the shutter 14 by means of an interface member (not shown in FIG. 1). The positioning/shielding module 16 includes an X-ray shielding component 40, a positioning component 42 for the X-ray lens 28, and a lens assembly mounting component 44 for rigidly coupling the tube member 50 with the X-ray lens 28 to the positioning component 42. The individual components 40, 42, 44, which are shown only schematically in FIG. 1, are illustrated in more detail in the various views of FIGS. 2 to 4.

Figure 3:
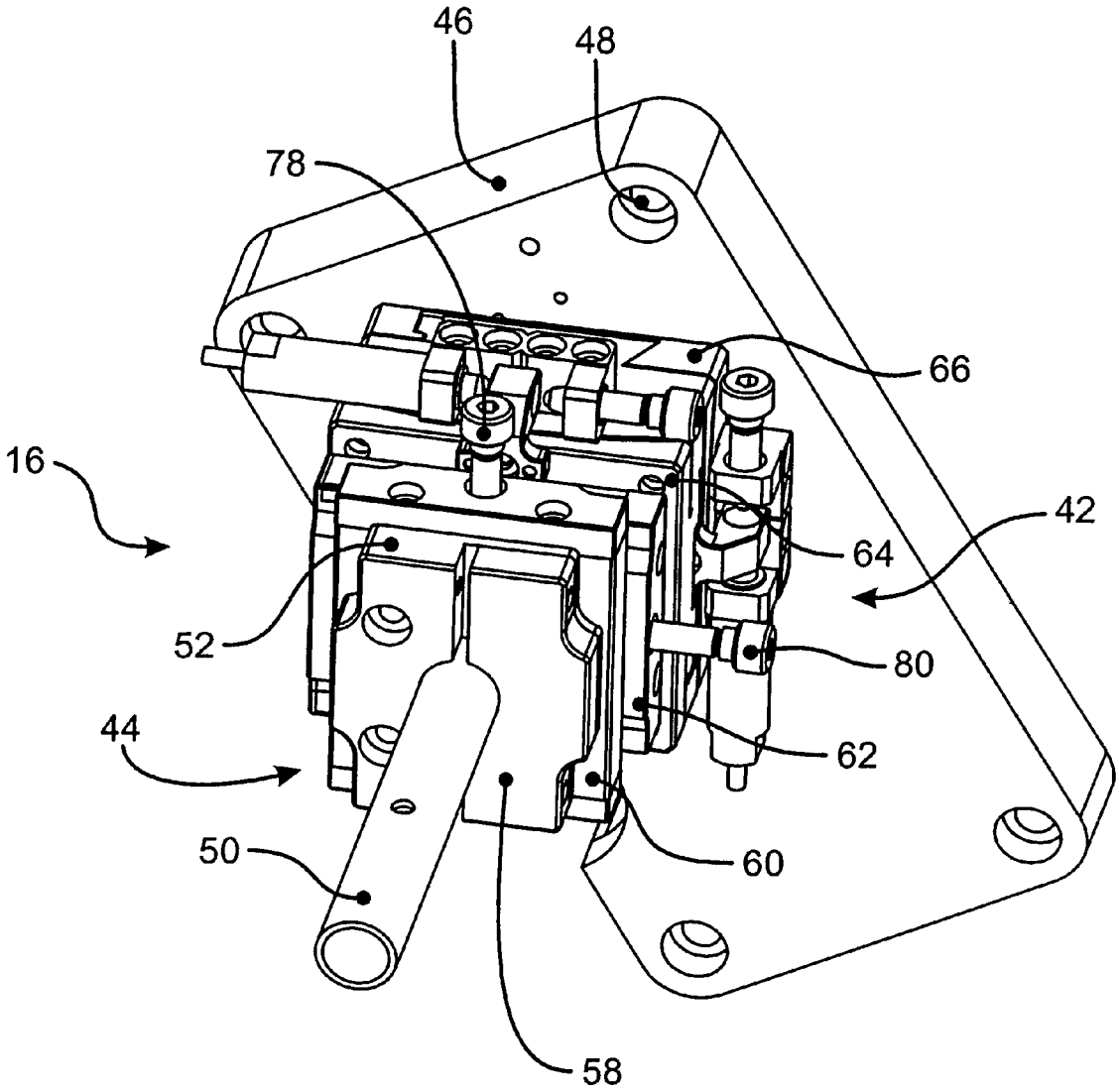
FIG. 3 shows a perspective view of the downstream end of the apparatus of FIG. 2.
Figure 4:
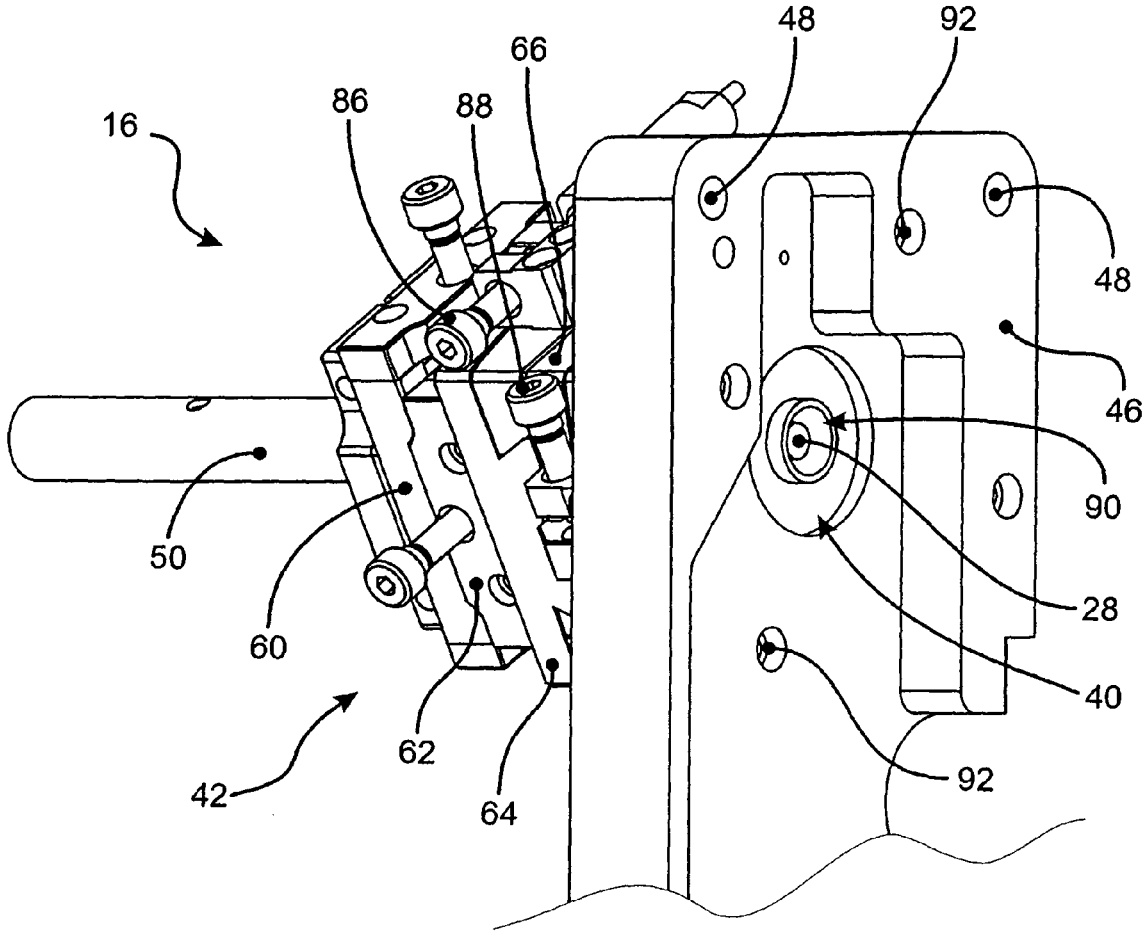
FIG. 4 shows a perspective view of the upstream end of the apparatus of FIG. 2.

As becomes apparent from FIGS. 3 and 4, the X-ray shielding component 40 has an outer flange 46 with two screw holes 48 for rigidly attaching the entire positioning apparatus 16 to the shutter 14 (and thus to the X-ray source 12). The outer flange 46 therefore serves as an interface member of the positioning/shielding module 16 in relation to the shutter 14/the X-ray source 12. The X-ray shielding component 40 further comprises structural elements for limiting the X-ray beam essentially to an inlet opening 90 of the tube member 50.

As will be explained in more detail below, the X-ray lens 28 is rigidly mounted inside the tube member 50. The tube member 50 in turn is rigidly coupled to the mounting component 44. The mounting component 44 comprises a base member 52 attached to the positioning component 42. The base member 52 has a central opening for receiving the tube member 50. A plurality of tongues 54 with outer threaded portions 56 extend from the opening of the base member 52 and in the axial direction of the tube member 50.

The lens mounting component 44 further comprises a collar member 58 with a central opening through which the tube member 50 extends. The collar member 58 can be screwed onto the tongues 54 and cooperates with their outer threaded portions 56. Be means of an additional screw (not shown) extending in perpendicular to the tube member 50 and through the collar member 58, the free end of at least one of the tongues 54 can be moved towards the tubular member 50 as the screw is screwed into the collar member 58. Accordingly, a clamping connection between the tubular member 50 on the one hand and the lens mounting component 44 on the other hand is established.

The positioning component 42 is arranged upstream of the lens mounting component 44 and includes two translation stages 60, 62 as well as two goniometer stages 64, 66. As can be seen from FIG. 2, the base member 52 of the lens mounting means 44 is attached to the bottom of the first translation stage 60.

The individual positioning stages 60, 62, 64, 66 are arranged one behind the other. Starting with a first translation stage 60 as the most downstream positioning stage, a second translation stage 62, a first goniometer stage 64 and a second goniometer stage 66 as the most upstream positioning stage follow. Each of the positioning stages 60, 62, 64, 68 has a central X-ray passage 68, 70, 72, 74, respectively, through which the tubular member 50 extends.

In combination, the first translation stage 60 and the second translation stage 62 form an xy translation stage. Accordingly, the first translation stage 60 has a first axis of translation, namely the x axis, which in FIG. 2 runs perpendicular to the axis of the tubular member 50 and in parallel to the drawing plane. The second translation stage 62 has a second axis of translation, namely the y axis which runs perpendicular to the x axis and perpendicular to the axis of the tubular member 50. By means of respective knobs, the first and second translation stage 60, 62 can be actuated independently from each other. In an alternative embodiment not shown in the drawings, a third translation stage having a third axis of translation (z axis) that runs perpendicular to both the first and second axis of translation may be provided.

The two goniometer stages 64, 66 are arranged upstream of the two translation stages 60, 62. In their combination, the first goniometer stage 64 and the second goniometer stage 66 form a theta-phi goniometer that provides for two independent rotations about a common centre of rotation. This common centre of rotation is substantially constituted by the "hot spot" 36 shown in FIG. 1, i.e. by the X-ray emitting portion of the X-ray source 12.

An actuation of the first goniometer stage 64 tilts the tube member 50 (with the X-ray lens) about a first tilting axis that runs through the "hot spot" 36 shown in FIG. 1 and in the drawing plane of FIG. 1 perpendicular to the optical axis 30. An actuation of the second goniometer stage 66 tilts the tube member 50 about a second tilting axis that also runs through the "hot spot" 36 and that is perpendicular to both the first tilting axis and the drawing plane of FIG. 1.

The X-ray shielding component 40 (only schematically shown in FIG. 1 and not completely shown in FIG. 4) is attached to the upstream end of the second translation stage 66 via screws extending through openings 92 in the flange portion 46 (FIG. 4). The shielding component 40 is configured to block all X-rays outside the circular X-ray passage defined by the upstream (inlet) opening 90 of the tubular member 50 and thus efficiently shields the positioning component 42 from X-rays. Accordingly, the individual components of the positioning component 42 (such as the translation stages 60, 62 and the goniometer stages 64, 66) can without any X-ray safety problem be manufactured from conventional materials (such as aluminium) which generally are transparent or nearly transparent to X-rays.

Figure 5:
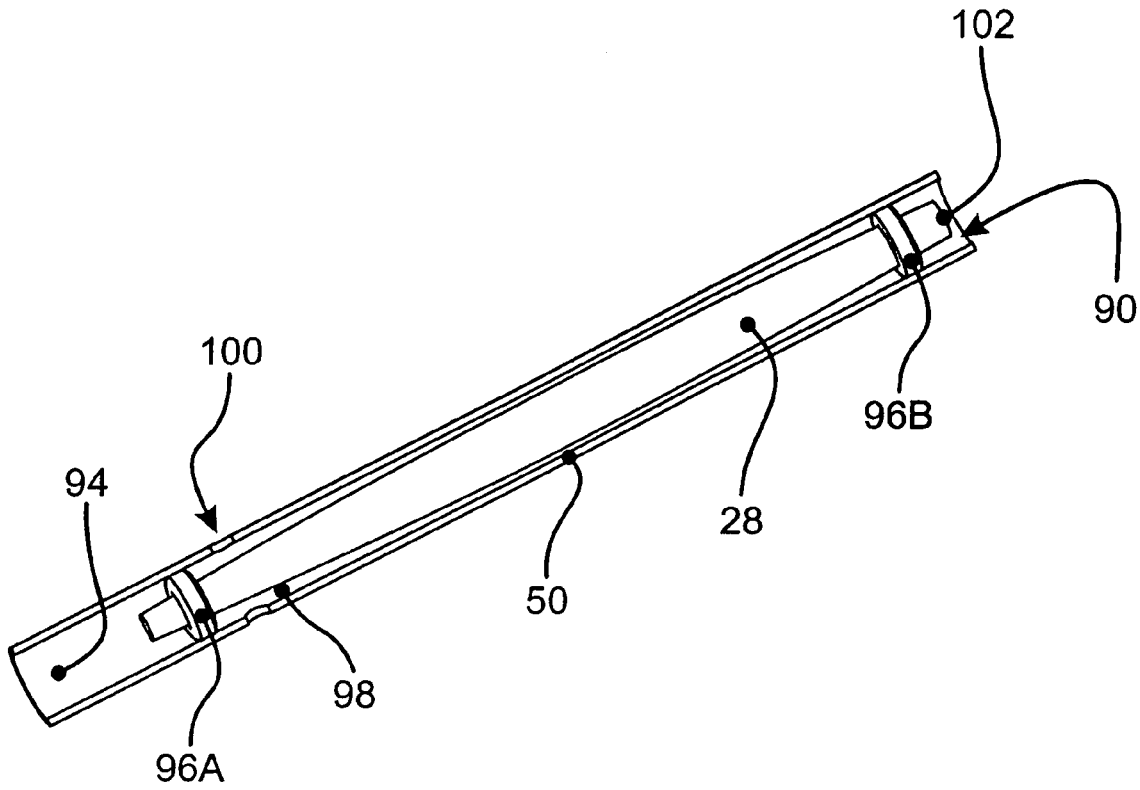
FIG. 5 shows a cross sectional view of an embodiment of the lens mounting assembly.

FIG. 5 shows a cross sectional view of the X-ray lens assembly including the tube member 50 and the capillary X-ray lens 28 mounted inside the tube member 50. In addition to the inlet opening 90 for X-rays already explained with reference to FIGS. 2 and 4, the tube member 50 further includes an outlet opening 94 for X-rays. In the embodiment shown in FIG. 5, the tube member 50 has a length that is larger than the length of the X-ray lens 28. In an alternative embodiment, the length of the tube member 50 could be chosen to be equal or smaller than the length of the X-ray lens 28.

The X-ray lens assembly shown in FIG. 5 includes two mounting structures 96A, 96B in the form elastic O-rings. The first mounting structure 26A is arranged close to the outlet opening 94 of the tube member 50, and the second mounting structure 96 is arranged close to the inlet opening 90. The two mounting structures 96A, 96B limit a chamber 98 that is located between an inner surface of the tube member 50 and an outer surface of the X-ray lens 28. The chamber 98 is filled with hardened glue reliably stabilizing the position of the X-ray lens 28 within the tube member 50. The glue has been filed into the chamber 98 through openings 100 provided in a wall of the tube member 50 in a region between the two mounting structures 96A, 96B.

The X-ray lens assembly shown in FIG. 5 can be manufactured as follows. First, the two mounting structures (i.e. the O-rings) 96A, 96B are put over the body of the X-ray lens 28 and pre-positioned. Thereafter, the X-ray lens 28 is introduced together with the mounting structures 96A, 96B into the tube member 50. In a next step, the X-ray lens 28 is brought into the correct axial position with respect to the tube member 50. In the embodiment shown in FIG. 5, the correct axial position is obtained by arranging an inlet opening 102 of the X-ray lens 28 in the same plane as the inlet opening 90 of the tube member 50. This plane intersects the axes of the tube member 50 and the X-ray lens 28 at a right angle.

Once the X-ray lens has been brought into the correct axial position inside the tube member 50, the mounting structures 96A, 96B are pushed uniformly into the tube member 50. Due to the barrel-shape of the X-ray lens 28 (which is thicker in the centre than at its ends), the elastic mounting structures 96A, 96B get expanded when pushed (from opposite sides) into the tube member 50. By means of this expansion, the X-ray lens 28 is clamped into the tube member 50. Moreover, the mounting structures 96A, 96B provide a fluid-tight termination of the lateral ends of the chamber 98. When pushing the mounting structures 96A, 96B into the tube member 50, the X-ray lens 28 automatically gets centred. More specifically, the longitudinal axis of the X-ray lens 28 is aligned in relation to the longitudinal axis of the tube member 50.

In a next step the axial position of the X-ray lens 28 in relation to the tube member 50 is checked again and, if required, corrected. In a last step a viscous glue is introduced into the chamber 98 through one or more of the openings 100 in the wall of the tube member 50. By choosing a glue (such as a silicon glue) having a comparatively high viscosity, the number and dimensions of openings 100 can be reduced. Preferably, the number of openings 100 is reduced to four or less, and in may cases two openings 100 will be sufficient.

In the assembled state, the tube member 50 functions as a mechanical protection for the capillary X-ray lens 28 during transport and/or mounting in the mounting component 44 and/or adjustment by means of the positioning component 42. The tube member 50 can accommodate X-ray lenses 28 of different dimensions, so that the mounting component 44 can be pre-adapted to the outer diameter of the tube member 50. Additionally, the reference for the adjustment of the X-ray lens 28 can be chosen to be the plane defined by the inlet opening 90 or the outlet opening 94 of the tube member 50. Accordingly, any necessary variations of the axial position of the X-ray lens 28 (e.g. due to different inlet focus distances of the X-ray lens 28) can be covered by choosing an appropriate axial position of the X-ray lens 28 within the tube member 50. Accordingly, there will be no need for additional customized flanges or adapters to adjust different types of X-ray lenses 28. Any remaining tolerance of the axial position of the X-ray 28 inside the tubular member 50 (of typically ±2.5 mm or less) can be compensated by the positioning unit 42 shown in FIGS. 1 to 4.

While the current invention has been described with respect to a particular embodiment, those skilled in the art will recognize that the current invention is not limited to the specific embodiment described and illustrated herein. Therefore, it is to be understood that the present disclosure is only illustrative. It is intended that the invention be limited only by scope of the claims appended hereto.

The invention claimed is:

1. An X-ray lens assembly, comprising:

a tube member including an inlet opening for X-rays and an outlet opening for X-rays;

a capillary X-ray lens;

axially spaced mounting structures mounting the X-ray lens inside the tube member; and a chamber defined between the tube member, the X-ray lens, and the mounting structures filled with a stabilizing agent that holds the X-ray lens in the tube member.

2. The X-ray lens assembly of claim 1, wherein the stabilizing agent includes a glue.

3. The X-ray lens assembly of claim 1, wherein the tube member further includes at least one further opening arranged between the inlet opening and the outlet opening, wherein the at least one further opening is in communication with the chamber.

4. The X-ray lens assembly of claim 3, wherein the stabilizing agent has been filled into the chamber through the at least one further opening.

5. The X-ray lens of claim 1, wherein the one or more mounting structures comprise at least one elastic member.

6. The X-ray lens assembly of claim 5, wherein the at least one elastic member comprises an elastic ring.

7. The X-ray lens assembly of claim 1, wherein the mounting structures allow for an axial displacement of the X-ray lens inside the tube member.

8. An X-ray device, comprising an X-ray source; and an X-ray lens assembly including a tube member having an inlet opening for X-rays and an outlet opening for X-rays, a capillary X-ray lens, axially spaced mounting structures mounting the X-ray lens inside the tube member, and a chamber defined between the tube member, the X-ray lens, and the mounting structures filled with a stabilizing agent that holds the X-ray lens in the tube member.

9. A method of manufacturing an X-ray lens assembly, comprising:

providing a tube member having an inlet opening for X-rays and an outlet opening for X-rays;

providing a capillary X-ray lens; and mounting the X-ray lens inside the tube member using axially spaced mounting structures; and filling a chamber defined between the tube member, the X-ray lens, and the mounting structures with a stabilizing agent that holds the X-ray lens in the tube member.

* * * * *